United States Patent [19]

McCormick et al.

[11] Patent Number: 4,808,237

[45] Date of Patent: Feb. 28, 1989

[54] METHOD AND COMPONENTS FOR CLEANING SILK SCREENS

[76] Inventors: James P. McCormick, 2229 E. 10375 South; Alan G. McCormick, Jr., 2221 E. Debeers Dr., both of Sandy, Utah 84092

[21] Appl. No.: 9,836

[22] Filed: Feb. 2, 1987

[51] Int. Cl.[4] ..... B08B 30/00

[52] U.S. Cl. ..... 134/26; 134/39; 134/40; 134/122 R; 134/200; 101/424; 101/425; 210/108

[58] Field of Search ..... 134/10, 22.11, 22.14, 134/39, 26, 113, 104, 122 R, 144, 165, 200, 39, 40; 101/424, 425; 210/106, 108

[56] References Cited

U.S. PATENT DOCUMENTS

| | | | |
|---|---|---|---|
| 3,580,261 | 5/1971 | Key | 134/122 R |
| 3,620,234 | 11/1971 | Everroad | 134/113 |
| 3,656,493 | 4/1972 | Black et al. | 134/113 |
| 4,420,004 | 12/1983 | Jenson | 134/122 R |
| 4,561,903 | 12/1987 | Blaul | 134/10 |
| 4,717,426 | 1/1988 | Brynildsen | 134/26 |

*Primary Examiner*—H. M. S. Sneed

*Assistant Examiner*—Sharon T. Cohen

*Attorney, Agent, or Firm*—M. Ralph Shaffer

[57] ABSTRACT

A method, and components therefore for cleaning and reclaiming silk screens and the like. The method involves the steps, in general, of handspraying silk screens to be cleaned at a nominal water pressure of 3,000 psi plus or minus 300 psi, and this preferably at a water temperature of from 70 to 140 degrees Fahrenheit. The water circulating system is preferably a closed system that is periodically automatically replenished as needed. This saves a volume of water required, and such water is reclaimed by filtering systems. The filtering structure employed comprises a series of classifier screens of progressively reduced mesh and disposed in mutually superposed position. A further filter is in the form of a disposable bag filter made of paper or other suitable material preferably having a pore size of the order of ten microns. Additional filters are employed as needed. The spray cabinet employed has silk screen support bars and clamping means for clamping the screens in sloping condition. The cabinet itself has an open front so as to provide access to an exterior spray position point.

5 Claims, 2 Drawing Sheets

METHOD AND COMPONENTS FOR CLEANING SILK SCREENS

FIELD OF INVENTION

The present invention relates to methods and structures for cleaning and reclaiming stencil screens known as "silk screens" in the art, and, more particularly, provides a method, system, and components thereof which accomplish the cleaning function very effectively and without the otherwise requisite need for the employment of solvents, stripping agents, and the like.

BACKGROUND OF INVENTION AND BRIEF DESCRIPTION OF PRIOR ART

Silk screens, also known in the art as screen stencils and printing screens, reside in a well-established and developed art, such screens being employed in a wide variety of ways for imprinting textiles, completed items of clothing, producing poster art, graphic art, circuit boards, and so forth. As a term of convenience, and as is customarily employed in the art, "silk screen" shall be used herein to denote any type of stenciling item of the type described and of whatever material made. Commonly, silk screens have a metal, e.g. aluminum, or wood frame which clamps into its central opening a fabric such as a polyester fabric comprising the screening element. There are several methods extant for producing a stencil on the screen. One method is to apply a light-sensitive emulsion to one or both sides of the screen element, as by means of a squeegee or another suitable applicator; subsequently, an image is shot onto the emulsion in a camera room and the screen is then taken to a washout booth. The sensitized areas of the emulsion remain, and the remaining emulsion is simply washed out. There are other ways, of course, in applying a stencil to a silk screen, as by other types of substitute materials for the emulsion, whether chemical or otherwise, and may include simply cut-out film strips, and so forth. In making up the pre-press screen, i.e., before it goes "to press", it is preferable to tape the screen by a conventional masking tape or other suitable materials, proximate the frame and especially the frame corners, this so that when the silk screen is to be cleaned, water jets will not have to be directed to the frame corners that might produce unwanted splashing.

Silk screens are expensive, and the user almost always will wish to reclaim the screens if possible for additional uses once a press run has been made. Much of the taping can be removed simply by hand; however, little flecks of tape may still remain on the screen. Also, there is the very formidable matter of removing the stencil, i.e., the used sensitized emulsion areas, and also the inks that have been employed in the printing process. Further media is used for printing, i.e. inks, illuminescent substances, dyes, and so forth, the same are generally soluble only in certain types of non-acqueous chemical solvents. Indeed, it is a great chore to remove the emulsion, masking tape specks, and inks even with the employment of solvents, strippers, and so forth. Additionally, federal and state agencies, in attempting to obviate hazardous working conditions for employees and being concerned with environmental protection, frequently have very stringent rules for the employment of solvents, and it has become increasingly difficult for the silk screen industry to operate under such constraints. It will of course be highly desirable for a system to be devised wherein simply water alone, without the employment of strippers, solvents, and the like, can be used in cleaning silk screens effectively. Prior to this invention this has simply not been possible.

Certain U.S. patents are noted for general purposes of high-pressure cleaning in other arts. These are as follows: U.S. Pat. Nos. 3,147,767, 4,112,535, 3,360,400, 4,350,174, 4,603,661.

The above enumerated patents are relevant as to the principle of power washing in general but are employed in non-analogous arts to the silk screen art. Thus, methods for cleaning walls of a vehicle, see Wild, U.S. Pat. No. '535 above identified,have employed liquid pressures approximating the pressure necessarily used by the inventor herein in cleaning silk screens. Others of the patents, however, relate simply to cleaning slag deposits from cyclone burners, the interiors of nuclear power equipment, castings, and so forth.

As to the methods and apparatus for cleaning silk screens: three patents, these being U.S. patents, are known to the inventor, which are identified as follows: Key U.S. Pat. Nos. 3,580,261, Black, et al 3,656,493, Jensen 4,420,004.

All of the above patents are relative insofar as jet spray cleaning of silk screens are concerned. All of these patents, however, use closed cabinets and elaborate means for spraying, solely interiorly of such cabinet, the screens within. There is no teaching in any of these patents of spraying from a point exterior to the cabinet. Nor is there any teaching that water alone can be used to reclaim the screens provided, whereas in the present invention, the water is maintained within a range of elevated temperatures and pressure so as to avoid completely the otherwise necessary employment of solvents, strippers, detergents, and the like. Thus, in the present invention, the environmental impact of use of the equipment is minimized if not eliminated. Reservoirs of cleaning fluids have heretofore been employed, as for example, in the Key U.S. Pat. No. '261 above cited. However, the cleaning media constitutes a highly flammable solvent, a stripper, or the like. There is no provision in any of the above patents for a closed water system and sophisticated filtering system wherein the water coming from the spraying step may be filtered and recycled for further use. Additionally, as is hereinafter pointed out, a bypass system is included such that the pump accommodating the present invention may be running continuously while the spray gun employed is actuated intermittently.

DESCRIPTION OF PRESENT INVENTION

An important crux of the method employed in the present invention is to use, as a spraying medium, tap water, preferably at a temperature of from 70° F. to 140° F., and preferably nominally 100° F.; such water is used by the spray gun involved at pressures nominally 3000 lbs. per square inch. This spray pressure can deviate not more than plus or minus 300 psi. It has been found that, operating at these unique pressures, so far as silk screen cleaning is concerned, all of the material can be removed from the screen, i.e., inks, emulsions, masking tape flecks, and so forth, without damaging the screen. It has been found that when one exceeds 3300 psi, screen materials are apt to be damaged; if below 2700 psi there is difficulty in removing the stencil, emulsion, and the various inks that are employed in the press-run process. Additionally, cold water has been found slightly ineffective for certain inks and emulsions; however, if the temperature is elevated, preferably, to a range of from 70° F. to 140° F., the materials can be removed easily without using solvents, strippers, or decomposing the substances used.

The spray cabinet of the invention has means for clamping the screens in place for cleaning and, most importantly, has an open front so that spray access can be obtained for cleaning the screens. Since there are no solvents employed, there is no danger to the worker even when the front is open. Where the back of the cabinet is sloped downwardly then there is minimized any back-splash relative to ejections from the spray guns.

The filtration system employed herein utilizes several filters, the filter units being unique to the industry. One concerns a classifier unit having a series of superposed classifier trays with mesh sizes proceeding from small to very small as one goes from the top classifier tray to the bottom one in the unit. This classifier unit has an outlet opening that communicates with a lower unit, the latter being spaced from the upper unit and having a bag-type filter. The filter itself is deemed unique and includes an elasticized margin that can surround and releasably grip about the lip of the unit. This bag filter should have a pore size of about 10 microns, preferably.

In a preferred form of the invention, this latter filter unit also comprises a closed system reservoir, the same preferably having a heater, return bypass port, and a float valve inlet to facilitate fluid replenishment as needed. Moreover, the circulation system herein is a closed system, essentially, with the high-pressure fluid pump employed operating continuously even though the spray gun used by the workmen is operated only intermittently.

In one form of the invention a sump is provided under the cabinet, a sump pump being used to pump the drain fluid from the cabinet into the first classifier unit having the classifier-tray series.

Accordingly, in the invention a minimum of liquid media, i.e., water, is employed. The water need not be used with solvents, strippers, or other materials for cleaning the screens; hence, danger to workmen is obviated. Finally, time need not be taken in opening and closing the cabinet, since, at the pressures utilized, no substantial backspray will develop. Further, workmen need not be protected from any solvents, or other deleterious materials, since these simply are not employed.

While various ones of the components can be used in other fluid delivery systems, the same are ideally suited for the present system and are believed unanticipated by and unknown to the prior art.

OBJECTS

Accordingly, a principal object is to provide a new and improved spray cabinet for cleaning silk screens.

A further object is to provide a tap water delivery system for cleaning silk screens.

An additional object is to provide improved filtering units for liquid delivery systems.

An additional object is to provide an essentially closed hydro-system for cleaning silk screens.

An additional object is to provide a filter bag for use, conveniently, as proximate last-stage filter in a filtration process for liquids.

A further object is to provide an improved method, system, structure, and components therefor, for the purpose of cleaning and reclaiming printing screens known in the printing art as silk screens, as well as other devices.

BRIEF DESCRIPTION OF THE DRAWINGS

The present invention may best be understood by reference to the following descriptions, taken in consideration with the accompanying drawings in which.

DETAILED DESCRIPTION OF PREFERRED EMBODIMENTS

Figure 1:
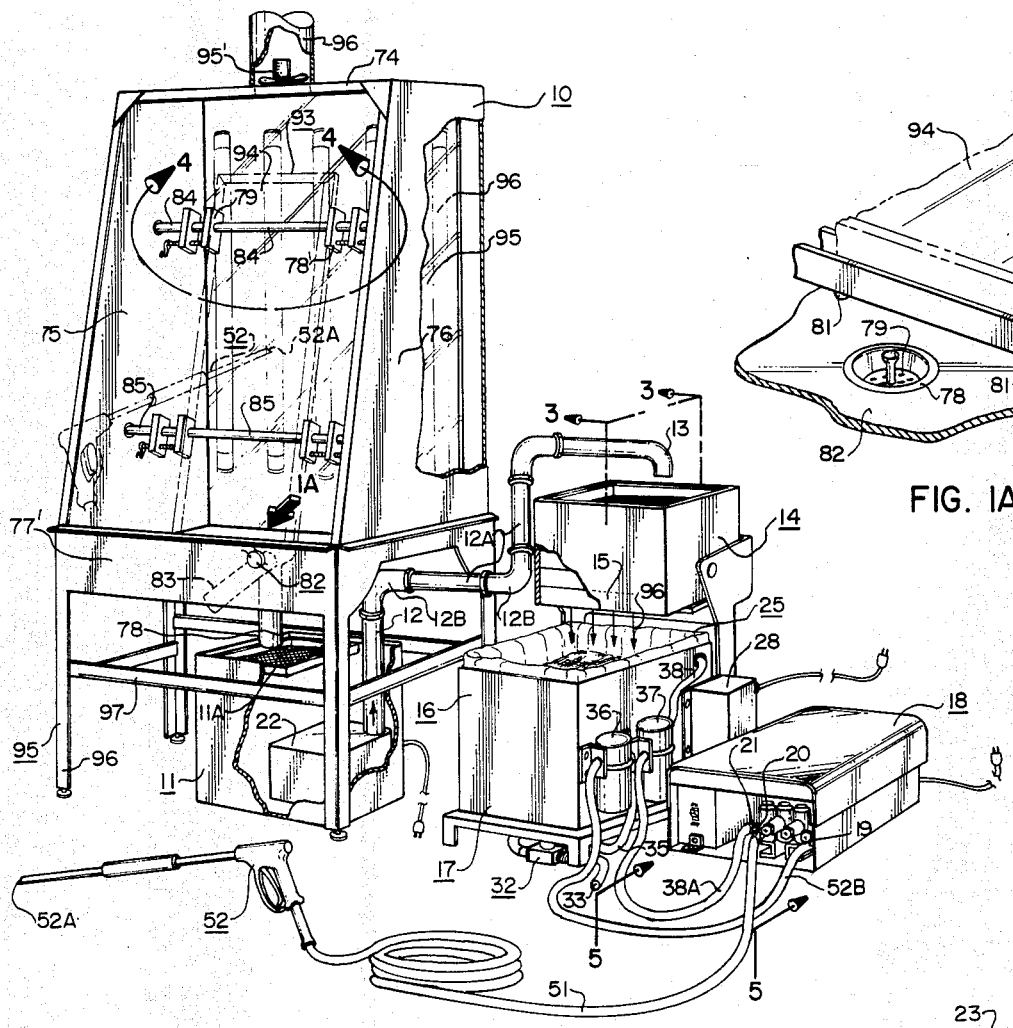
FIG. 1 is a perspective view of a system and components for cleaning silk screens and, for convenience of illustration, is partially broken away and sectioned.
Figure 1A:
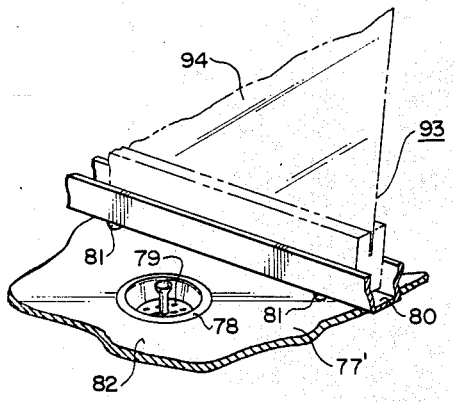
FIG. 1A is an enlarged fragmentary detail, shown in perspective, of a bottom portion of the silk screen cleaning cabinet, this illustrating a channel support within which the base of the silk screen can be secured against undesired movement.
Figure 2:
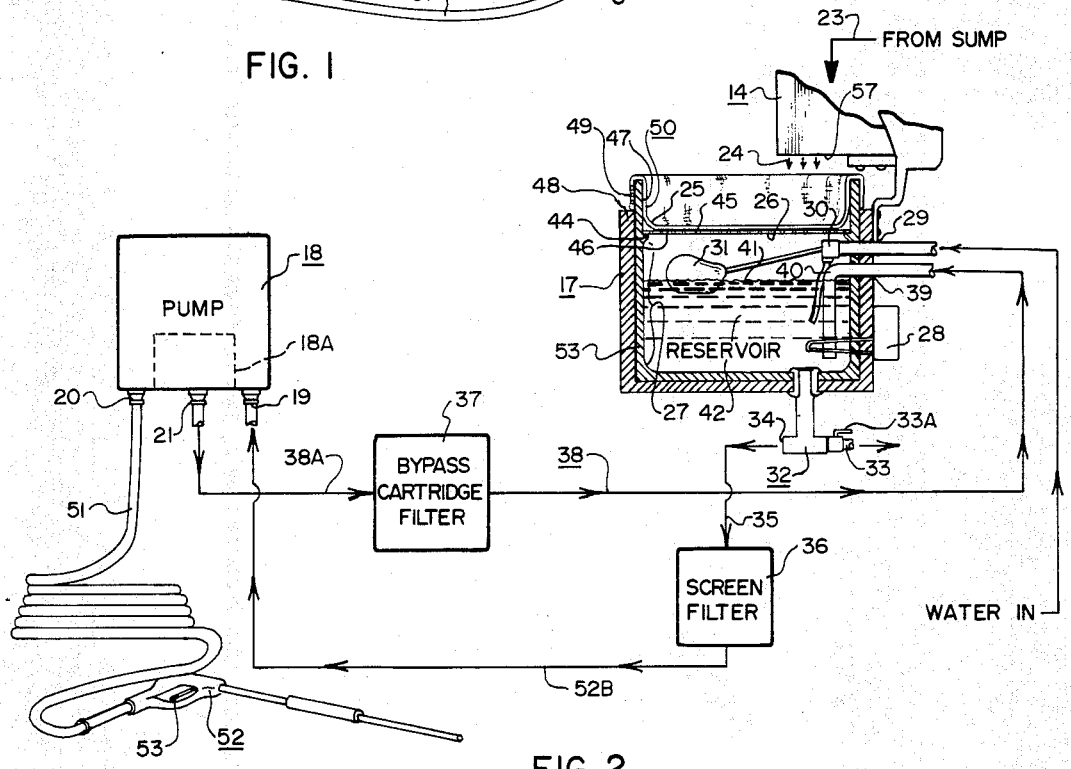
FIG. 2 is a schematic of the circulating circuit used in the system.

In FIGS. 1 and 1A a silk screen cleaning and washout cabinet 10, is provided, the same including a sump 11 having a conventional, fluid-level responsive sump pump 22. The details of the cabinet 10 and sump 11 will be described hereinafter. Suffice it to say at this point that sump 11, receiving waste from the cabinet via conduit 78 and initial sump screen 11A, has an outflow delivery conduit 12 which proceeds to spout 13, the latter pointing into the interior of classifier filtration unit 14. Classifier unit 14 has a bottom drain aperture 15 which drains into the upper portion 16 of reservoir 17. Reservoir 17 is provided with filtering apparatus and is shown in FIG. 2 which will later be described. The system also includes a pump 18 which is preferably electrically driven and which incorporates an inlet port 19, a high pressure port 20, and a bypass port 21.

The type of pressure pump 18 used in the system, as to general operation and structure, is well known in a number of different arts. The same may be similar to the pump used in carwash installations, hydraulic-drive sawmill feedworks systems, and so forth. Some such pumps, the inner details of which need not be described, will simply include a high pressure outlet port 20, a bypass port 21, and a fluid inlet port 19. The pump, 18, having a conventional unloader valve for bypass port 21, will be designed so that the bypass circuit via port 21 is operated by virtue of the said standard unloader valve, at the discharge (21) of the pump (18) back through the bypass circuit 38A when spray hand gun 52 is not operating. Various volumetic outputs through the hand gun will affect the percentage of fluid fed back by th pump to the reservoir 17 of the system through the bypass circuit 38A. Again, similar pumps are employed in a variety of arts and, for purposes of the present invention, recommended pumps being models HE63E, HE43E, and HE153E, as manufactured by Hydro Engineering, Inc. of Salt Lake City, Utah. While these are preferred types of pumps, other types of pumps might also be employed. Such a pump is electrically, driven and may require, for example, an enlarged, 20 amp or greater service.

Figure 5:
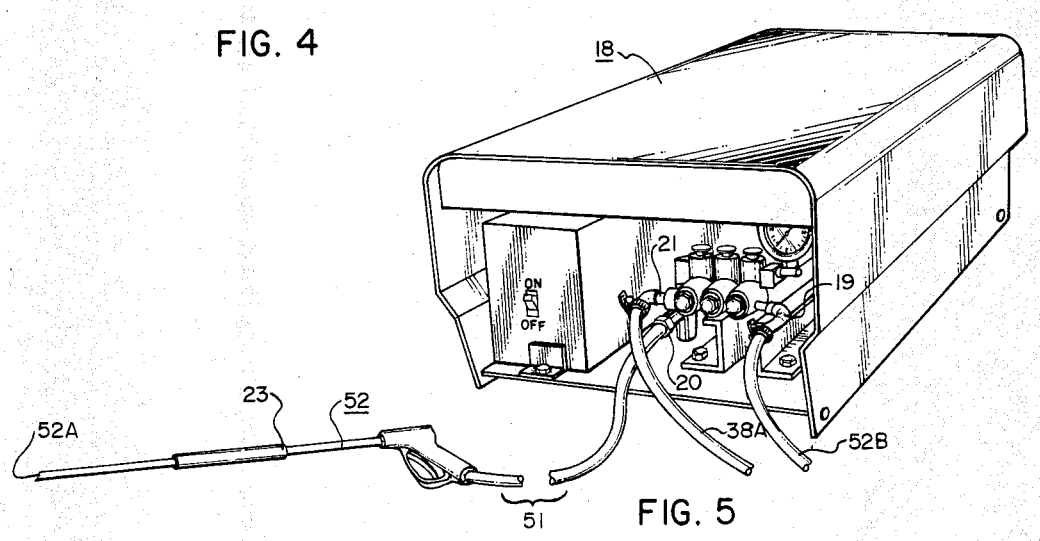
FIG. 5 is an enlarged detail, shown in perspective, of the liquid pump used in the system.

Before considering the details of the mechanical structure as seen in FIG. 1, it is deemed advisable to orient the reader by discussing the basic system schematically shown in FIG. 2. Drain fluid from cabinet 10 proceeds into sump 11 in FIG. 1 and is pumped by sump pump 22 to and in the direction of Arrow 23 in FIG. 2, and the same drops into classifier unit 14 via nozzle 13, where a majority of larger particles, ink, emulsion, tape and film, are filtered out by the classifier unit 14, hereinafter to be explained in detail. The fluid phase 24 proceeds into filter bag 25, having porous sheeting material 50 with pore sizes of the order of 10 microns, and the bag being supported by screen 26 in reservoir unit 17. Reservoir unit 17 contains a reservoir portion 27 the latter being provided with an electrically-operated heater probe 28 secured to the housing of the reservoir unit 17. Additionally, an inlet orifice 29 is provided the reservoir unit to accommodate inlet fluids such as water from an exterior replenishing supply source. Reservoir 17 is fitted with a float valve 30, the same having float 31, and both functioning in a manner similar to and being constructed essentially the same as valve apparatus in home water closets. Reservoir, unit 17 includes a lower tee drain 32 having a first valve outlet 33 and second outlet 34. Valve 33 may simply be opened to drain the fluid completely from the reservoir into a building drain or holding tank. Outlet 34 always remains open to conduct the recirculation fluid from the reservoir along Arrow 35 through screen filter 36 and from thence to the inlet port 19 of pump 18. Bypass cartridge filter 37 may be conventional in design, as will also be screen filter 36, with filter 37 being interposed in the circuit 38 connecting bypass port 21 to bypass return port 39 leading to conduit 40, the latter being mounted in the reservoir and oriented downwardly underneath fluid level 41 of the reservoir pool 42. Disposed in the container or reservoir unit 17 is an interior-peripheral angular support unit 44 that supports a support screen 45. Screen 45 is itself used to support the bottom 46 of filter bag 25. Filter bag 25 may be made of paper, plastic or the like, and includes pores in the material of the same of the order of 10 microns, by way of example. Various sizes of pores may be appropriate, depending upon the material on the silk screen which is to be removed. This bag filter represents essentially a final filter stage, and so the pore openings should be quite small. The bag filter itself is deformable and slack, and the same has a peripheral margin 48 containing elastic 49 or other suitable resilient means. The margin 48 of bag 25 is constructed so that even when the margin is taut, some slack will occur in the flexible deformable, water pervious, sheeting material at 50 forming a major portion of the filter bag. Again, this material may be paper, coated or otherwise, fabric, plastic, or other suitable material where the same is porous, functioning to entrap small particles while permitting the fluid phase to pass therethrough to the reservoir portion 27 having water pool 42. High pressure port 20 of the pump connects to flexible elongate conduit 51 such as a rubber or neoprene hose, which leads to the conventional spray gun 52 (see FIG. 5)provided with actuating trigger 53 in the customary manner. The gun may be strictly conventional and resemble those currently used in car wash establishments. Portion 38A of the bypass circuit 38 will be coupled to and between bypass cartridge filter 37 and bypass port 21 of pump 18. Conduit 52B intercouples the outlet of screen filter 36 with inlet port 19 of pump 18.

Figure 3:
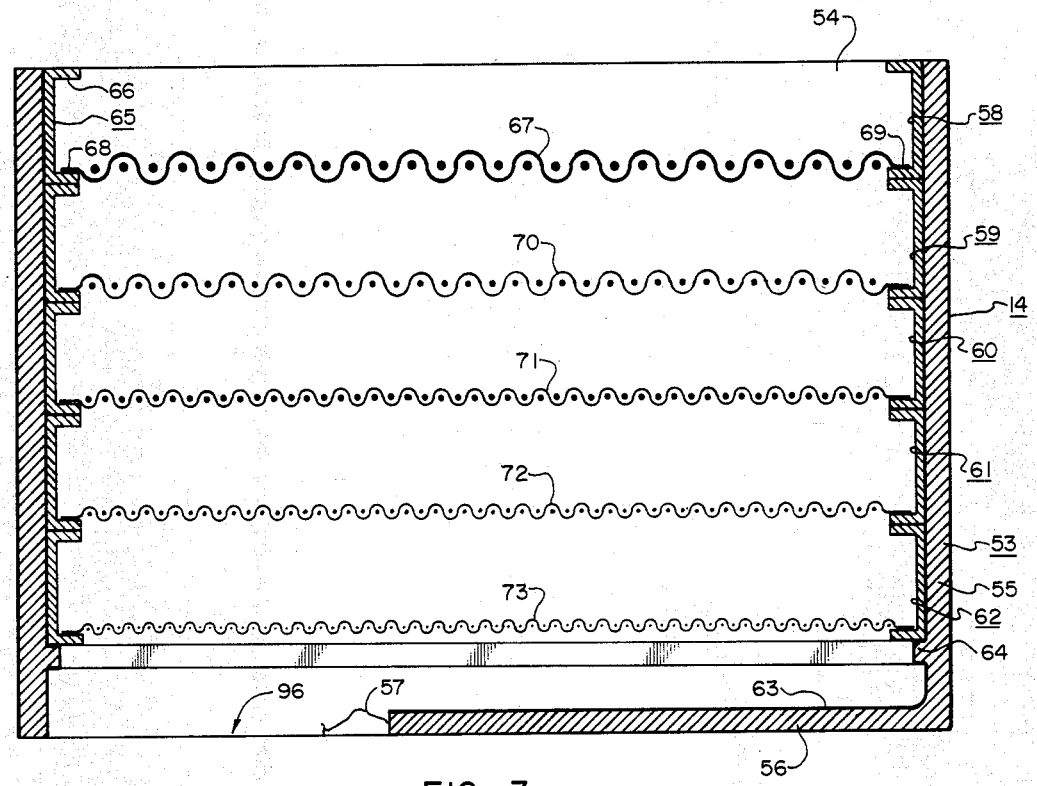
FIG. 3 is an enlarged vertical section taken along the line 3—3 in FIG. 1, illustrating the construction of the classifer filtration unit employed in the system.

In FIG. 3, classifier unit 14 comprises a box-like container 53 having an open top 54, and a plurality of upstanding sides 55 that ascend from the peripheral edges of bottom 56. Bottom 56 includes a drain opening 57, see FIG. 3, which communicates, as shown in FIG. 2, with the filter bag 25 above the reservoir pool.

In FIG. 3, classifier unit 53 has, removably implaced therein, a series of classifier trays 58-62. The bottom tray may be designed to rest upon an inner protuberance such as an angle iron, sheet strip, or other means, fixedly disposed within the container, and above the bottom surface 63 thereof, at 64. Each of the classifier trays includes a rim 65, the cross-section of which may be a channel section such that the upper lip 66 is available for thumb and finger grasp so that the tray might easily be removed periodically as may be desired. This feature will be standard with all of the trays. A classifying screen filter 67 is secured at opposite ends 68 and 69 for each of the classifier trays, with the screens 70, 71, 72, and 73, as one goes from the uppermost classifier screen to the bottom screen, being progressivley of smaller pore or mesh size. By way of example, as one proceeds from the top classifier screen 67 to the bottom classifier screen 73, screen 67 can be a number 16 mesh screen on the Tyler standard screen scale, adopted by the U.S. Bureau of Standards, progressively lower screens permissibly being of the following mesh numbers: 30, 60, 80, and 100. As is well known in the art, screen size is determined not only by the number of wires in the mesh but also wire size. In the Tyler Standard Sieve Scale for a 200 mesh screen, the opening is 0.0029 inches and the wire diameter is 0.0021 inches. There are established varieties of wire diameters and sieve or aperture openings for various mesh numbers. This is all customary in the art. The smallest pore size should, of course, be regulated to the filter bag 25 hereinbefore described, in FIG. 1, just before the return fluid drops into the reservoir pool 42. At the reservoir itself and beyond, there may be interposed screen filter 36 for final filtration prior to the fluid returning back to pump 18 at inlet port 19.

The details of the cleaning cabinet 10 will now be considered. Cabinet 10 includes a top 74, opposite sides 75 and 76, a bottom 77' that is designed as a well for receiving contaminated fluid that is to be conducted down drain 78 via drain strainer 79 and screen 11A. See FIG. 1A. The drain pan area or bottom preferably includes a channel 80 provided with beads 81, by way of example, which support the channel bottom above and secure the same to the base 82 of the drain pan area 77' of the wash cabinet. This is for the purpose of insuring fluid-flow at all portions of the cabinet toward the drain. Splash guards, not shown, can be provided the cabinet as needed. A three-way ball valve 82 may be supplied, the turning of one position of the same being effective to supply drain fluid to conduit 78, whereas another positioning may simply route the drain fluid to a building drain, not shown, by suitably supplied conduit as at 83.

Figure 4:
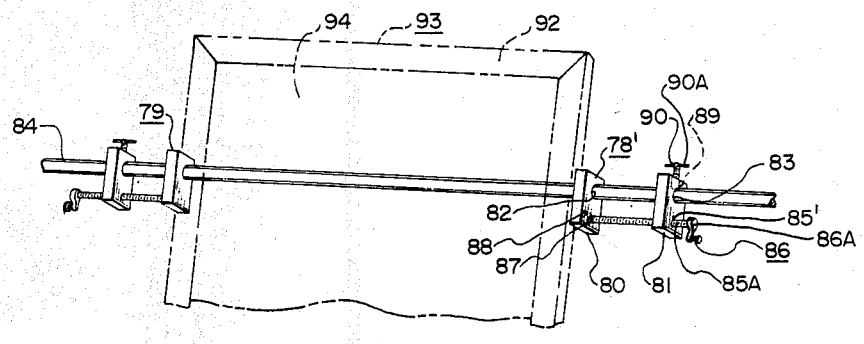
FIG. 4 is an enlarged fragmentary perspective of a representative support rail and clamping means, employed to clamp a silk screen frame to be cleaned, against movement.

In FIG. 1 and 4 a pair of horizontal indented rails 84 and 85 are mounted to and between sides 75 and 76, and include thereon respective sets of clamps 78 and 79 for each of the rails.

These clamps may simply comprise, respectively, a pair of flanges 80 and 81 having side apertures 82. Flange 81 includes a threaded aperture 85' for receiving the threaded shank 85A of rotating screw 86 which can have a hand manipulator 86A for hand operation. The ball end 87 of shank 85A is fitted into a closed socket 88 of flange 80 so that such end will not become disengaged with the socket 88. Clamps on both sides of the frame, as to both sets for the respective rails 84 and 85, may be identical. The respective flange 81 (see FIG. 1A) of the clamps may be provided with an aperture at 89 for accommodating a manually turnable set screw element 90, the same having a handle 90A. Accordingly, in operation, the outermost flanges are clamped to the rail 84, 85 by turning of the set screw handle and, subsequently, the inner flange as at 80 is urged forwardly toward the frame 92 of silk screen 93 to be cleaned. Frame 92 will be of metal, generally aluminum, wood, or other suitable material. The screen 94 secured by the frame 92 may be a polyester fabric, stainless steel mesh, or any one of a number of fabrics, sheetings, and the like that are in mesh or woven form and are employed to create printing stencils. Screens 94 themselves are prepared by using masking tape proximate the frame margins and corners, and then employing any one of a number of types of emulsions or films that can be sensitized. The manner of producing silk screens is common and well known in the art; in lieu of emulsions, paste-up materials such as film or other media can be employed to block ink or other media transmission through the screen to the item to be printed upon. When emulsion is employed, a squeegee or similar item is generally used to smooth the liquid emulsion over both sides of the screen; subsequently, after exposure in the camera room, the nonsensitized areas are simply washed out of the screen in a washing room so that the pattern appears as exposed pores in the screen. The remaining emulsion that has been sensitized and fixed simply remains as an opaque stencil to preclude the passage of inks and dyes therethrough to the item to be printed. Such silk screens are well known in the art and are clamped into position against the horizontally offset rails 84 and 85, the degree of inner offset as to rail 84 being determined by the slope, bottom front to top rear, that may be required to convenience the workmen. The bottom of the frame will be conveniently placed in a channel 80 of FIG. 1A so as to preclude inadvertent movement, forward and rearward, of the screen. The opposite margins of the screen frame are clamped by the clamping means shown in FIGS. 1 and 4. Preferably, channel 80 in FIG. 1A will be affixed at a desired location to the base of the drain pan of the cabinet so that the frame itself can be generally secured against movement, at least forwardly and rearwardly, immediately prior to the time that the clamps are secured against the opposite sides of the frame. A stand 95 may be employed to maintain the washing cabinet in an erect position, the stand having suitable legs 96 with joined crosspieces 97. Cabinet 10 permissably includes exhaust fan (95') secured in venting duct 96. Sump pump 22 will be of standard construction, electrically driven, and provided with output conduit riser 12 which, with conduit 12A and the respective joining elbows 12B, will provide fluid flow from the sump to outlet spot 13 immediately above classifier unit 14.

It is preferred that the cabinet back 95 joined to the rear margins of sides 75 and 76, be transluscent and provided with exterior lighting means at 96 such as fluorescent lights for lighting the back panel. This is highly desirous for the user to inspect closely the silk screens being cleaned by spray gun 52.

In operation, in a highly preferred form of the invention, the pump 18 is selected, as for example from the pump models hereinbefore enumerated, so that the high-pressure delivery hose at 51 leading to spray gun 52 delivers pressure from 2700 to 3300 psi at the nozzle end 52A of the spray gun. This is commonly referred to in the art as medium-elevated pressures, and in the invention a preferred operating pressure is 3000 psi, with deviations of 300 psi on either side of this nominal value being permissible. The reason for the selection of such a pressure and pressure-range is as follows: It has been found through experimentation that, for conventional emulsions, inks and dyes as are now used in silkscreen procedures, whether at the pre-press stage or actually in the press operation, such inks, emulsions and also masking tape flecks can be hydro-driven off the screen at this pressure range without the employment of strippers or solvents. This is most important, since environmental protection agency standards are becoming increasingly restrictive as to the employment of solvents and contaminates, by way of example. Further, at such pressures, steam is not produced, and the process has proven highly satisfactory when the water is preheated as by probe 28 relative to the reservoir 17, to a nominal temperature of 100° F., a desired temperature range being from 70° F. to 140° F. Even at the pressure specified, where the water is cold tap water, then cleaning effectiveness is slightly less than desired. Where the temperature is elevated to and slightly above room temperature, i.e., 70° F. to 140° F., then the water spray operates in a more satisfactory manner, particularly as to certain types of inks, particularly, that are employed with silk screens.

Accordingly, the method employed in the present invention, includes the steps of providing a cleaning cabinet constructed to contain a removable silk screen, such cabinet having a drain; providing a filter, closed water supply system communicating with said drain and containing water permissably heated to a nominal temperature of from 70° F. to 140° F., and then spraying such silk screens, for cleaning purposes, with such water only, and whether heated or not, as a water spray under pressure of from 2700 psi to 3300 psi. An additional step in the method is that of venting the cabinet so as to supply for the exhaust of water vapor upwardly.

A further improvement and modification in the method is where the cabinet has an open front such that the silk screen sprayer is provided exterior to the cabinet, by simply a spray gun utilized with a closed water supply system.

Accordingly, and in operation, the user clamps the silk screen in trough 80 and by means of clamps at 78' and 79. The pump 18 is turned on and the bypass system including port 21, bypass cartridge filter 37, and line 38, come into play. The amount of fluid bypassed is reduced, if not eliminated, depending upon the actuation of a trigger operated water spray gun 52, the same being directed toward the screen 93. Depending upon the setting of ball valve 82, the debris washed from the screen collects at the bottom pan of the cabinet, and much of the same can be caught by drain 79 and screen 11A in FIG. 1A. The latter resembles a conventional sink drain in a home that is removable. The water proceeds down conduit 78 to the sump area, where it is pumped by the sump pump 22 upwardly through conduit 12. The sump area may likewise include a float valve where the same is desired, albeit such is not really needed.

Accordingly, drain water from the sump goes up to the spout 13 where it drops freely down the classifier unit 14 to be filtered successively by the classifier trays or screens. Larger particulate matter is caught by the upper trays and the progressively smaller materials are caught by trays underneath. These trays can be periodically removed and washed within the cabinet proper.

The liquid phase thus descends through the classifier unit in the direction of Arrow 96 (see FIGS. 1 and 3) to proceed from the classifier unit directly into the reservoir or container at 17. Such liquid is filtered by the filter bag and proceeds through the screen support of the filter bag to the reservoir which is float controlled. The reservoir liquid is preferably maintained between 70° F. to 140° F., this by probe 28. Water in the reservoir is frequently replenished via inlet water supply at 30 as is accommodated by level-adjusting float valve 30 with float 31. Accordingly, the water level is maintained essentially constant within the reservoir portion of the reservoir container. The closed-system feature of the invention includes a closing of valve 32 at handle 33A so that drain, i.e., water from the reservoir, goes in the screen filter 36 and from thence into the inlet 19 of the pump. Thus, water is circulated in a closed system and is replaced only when the gun 52 is used; this is done automatically by virtue of level-control float 31.

What is provided, therefore, is a system such that., where desired, that water *only* need be employed to clean used silk screens for reclaiming the same. This is performed at a unique elevated pressure range so that solvents, stripping agents, and so forth, need not be employed for screen cleaning and reclaiming.

Additionally, the fluid cleaning medium, such as water, is maintained in a closed system and is not wasted, being replenished only periodically as the hand gun employed is used and portions of spray are lost to the atmosphere or vent.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

What we claim is:

1. A method of cleaning a silk screen including the steps of: providing a cleaning cabinet having an open front; supporting a removable silk screen in said cabinet; providing a water supply system; and spraying through said silk screen in said cabinet through said open front with solely water only from said system, essentially free of soaps, detergents, and hydrocarbons, as a water spray under pressure of from 2700 psi to 3300 psi to thereby remove from said silk screen contaminants including inks, dyes and emulsions whereby said contaminants flow to a drain structure operatively connected to said cabinet.

2. The method of claim 1 wherein there is provided the additional step of fan-venting said cabinet rearwardly and upwardly of said open front, thereby to circulate outside air into and through said open front and upwardly through and out said cabinet, to thereby carry moisture mist in said cabinet outwardly therefrom.

3. The method of claim 1 wherein the step of said spray such silk screen comprises providing a hand-held spray gun, held at a point exterior to said cabinet, and directing the same through said open front at said silk screen, and coupling said spray gun to said water supply system.

4. A method for cleaning a silk screen, including the steps of: providing a silk screen; providing a pump with a spray means coupled thereto for spraying with tap water only, essentially free of soaps, detergents and hydrocarbons, to thereby clean said silk screen of contaminants including inks, dyes and emulsions, said pump delivering such tap water to said spray means at a pressure 2,700 to 3,000 psi; and directing said spray means toward said silk screeen to spray through the same solely with said tap water.

5. A method of cleaning a silk screen, including the steps of: providing an open cleaning cabinet having an open front constructed to support a removable silk screen, said cabinet having drain structure operatively connected thereto; providing a water supply system containing water essentially free of soaps, detergents, and hydrocarbons; and spraying through such silk screen in said cabinet through said open front with water from said water supply system, said water spray having a pressure 2,700 to 3,000 psi, thereby to clean said silk screen.

* * * * *